US009453514B2

(12) United States Patent
Watz et al.

(10) Patent No.: US 9,453,514 B2
(45) Date of Patent: Sep. 27, 2016

(54) VACUUM PUMP HAVING FASTENING ELEMENT FOR SECURING ROTOR PART TO ROTOR SHAFT AND DEFORMED SAFETY ELEMENT PROJECTING IN AXIAL DIRECTION FOR PREVENTING RELATIVE ROTATION BETWEEN THE ROTOR PART AND ROTOR SHAFT

(71) Applicant: Pfeiffer Vacuum GmbH, Asslar (DE)

(72) Inventors: Robert Watz, Weilburg (DE); Bernhard Tatzber, Gruenberg (DE); Herbert Stammler, Griessen (DE)

(73) Assignee: Pfeiffer Vacuum GmbH, Asslar (DE)

( * ) Notice: Subject to any disclaimer, the term of this patent is extended or adjusted under 35 U.S.C. 154(b) by 446 days.

(21) Appl. No.: 14/016,475

(22) Filed: Sep. 3, 2013

(65) Prior Publication Data

US 2014/0072408 A1 Mar. 13, 2014

(30) Foreign Application Priority Data

Sep. 10, 2012 (DE) ..... 10 2012 108 394

(51) Int. Cl.

| | |
|---|---|
| ***F01D 1/36*** | (2006.01) |
| ***F03B 5/00*** | (2006.01) |
| ***F04D 19/04*** | (2006.01) |
| ***F04D 29/26*** | (2006.01) |
| ***F04D 29/32*** | (2006.01) |

(52) U.S. Cl.

CPC ..... *F04D 19/044* (2013.01); *F04D 19/04* (2013.01); *F04D 19/042* (2013.01); *F04D 29/263* (2013.01); *F04D 29/266* (2013.01); *F04D 29/321* (2013.01)

(58) Field of Classification Search

CPC .... F04D 19/04; F04D 19/042; F04D 19/044; F04D 29/263; F04D 29/266; F04D 29/321

USPC ..... 415/122.1, 124.2, 104, 107, 216.1, 90

See application file for complete search history.

(56) References Cited

U.S. PATENT DOCUMENTS

| | | | | |
|---|---|---|---|---|
| 2007/0031270 | A1 | 2/2007 | Maejima et al. | |
| 2009/0311113 | A1 | 12/2009 | Kettlewell | |
| 2012/0308380 | A1 | 12/2012 | Yamaguchi | |
| 2013/0243583 | A1 * | 9/2013 | Kawanishi | F04D 19/044 415/191 |

FOREIGN PATENT DOCUMENTS

| | | | | |
|---|---|---|---|---|
| DE | 202005019644 U * | 4/2007 | | F04D 19/042 |
| DE | 102010040288 A1 | 3/2012 | | |
| JP | 2000-205183 A | 7/2000 | | |
| JP | 2008-286179 A | 11/2008 | | |
| JP | 2012-127326 A | 7/2012 | | |
| WO | WO 2012077411 A1 * | 6/2012 | | F04D 19/044 |

* cited by examiner

*Primary Examiner* — Theresa Trieu

(74) *Attorney, Agent, or Firm* — Abelman, Frayne & Schwab

(57) ABSTRACT

A vacuum pump has a rotor mounted on a rotor shaft and provided with pump active components cooperating with opposite stationary pump active components, fastening element for securing the rotor on the rotor shaft, and a safety element provided in addition to the fastening element for preventing rotation of the rotor and the rotor shaft relative to each other.

9 Claims, 10 Drawing Sheets

VACUUM PUMP HAVING FASTENING ELEMENT FOR SECURING ROTOR PART TO ROTOR SHAFT AND DEFORMED SAFETY ELEMENT PROJECTING IN AXIAL DIRECTION FOR PREVENTING RELATIVE ROTATION BETWEEN THE ROTOR PART AND ROTOR SHAFT

BACKGROUND OF THE INVENTION

1. Field of the Invention

The present invention relates to a vacuum pump.

2. Description of the Prior Art

State of the Art (DE 20 2005 019 644 U1) discloses a vacuum pump, e.g., a turbomolecular pump having a rotor with rotatable pump active components and mounted on a rotor shaft. The rotatable pump active components cooperate with stationary pump active components, so-called stator.

The above-mentioned state of the art discloses securing of a bell-shaped rotor to an end side of a rotor shaft with a screw. To this end, the rotor shaft is provided with a recess in which the rotor journal engages.

The drawback of the embodiment disclosed in the state of the art consists in that the rotor can rotate relative to the rotor shaft because the connection of the rotor with the rotor shaft is essentially based on a frictional connection. Because of this, a relative rotation can occur in case of overload. The overload leads to loosening of the connection so that the security of the screw connection is not insured.

Loosening of the rotor during operation leads to a total damage of the pump. Prior art (WO 2012/077411 A1) discloses means for preventing rotation of the rotor. According to this state of the art, there is provided a formlocking connection at which the rotor is secured to the end side of the rotor shaft with several screws. This prevents rotation of the rotor relative to the rotor shaft and, thus, disengagement of the rotor from the rotor shaft. However, the drawback of this state-of-the-art embodiment consists in that the mounting of the rotor is rather expensive and a number of high-cost components, screws, is necessary which make the pump more costly.

The object of the invention is to provide a vacuum pump in which the above-discussed drawbacks of the prior art solutions are absent.

SUMMARY OF THE INVENTION

This and other objects of the invention which will become apparent hereinafter are achieved by providing a vacuum pump having at least one gas inlet opening, at least one gas outlet opening, at least one rotor shaft, a rotor mounted on the at least one rotor shaft and having rotatable therewith pump active components arranged opposite stationary pump active components, at least one fastening element extending in an axial direction and provided in or on the rotor shaft for securing the rotor on the rotor shaft, and at least one safety element provided in addition to the at least one element for preventing rotation of the at least one rotor and the at least one rotor shaft relative to each other.

The relative rotation-preventing safety element can be easily designed and formed, thus, providing a cost-effective solution of preventing rotation of the rotor relative to the rotor shaft and, thereby, loosening of at least one axially extending fastening element provided in or on the rotor shaft.

According to a particularly advantageous embodiment of the present invention, the safety element is provided on the centering journal of the rotor. The centering journal is easily accessible for the centrally arranged fastening element during mounting of the rotor, so that the arrangement of the safety element in the centering journal makes sense.

Basically, there also exists a possibility to provide the centering journal on the rotor shaft so that it would engage in a bore formed in the rotor.

When the centering journal is provided on the rotor, it engages in a corresponding opening of the rotor shaft.

There also exists a possibility that no journal is provided on the rotor and the rotor shaft. In this case, centering can be effected with one or several eccentric shaped elements such as register pins or combined shaped and fastening elements such as close-tolerance screws.

According to a particularly advantageous embodiment of the present invention, the safety element is formed as at least one pin engaging through or in the rotor shaft and through or in the rotor.

Such a pin can be very cost-effectively formed. In addition, the pin need not meet high requirements to the fitting precision, because the rotation of the rotor relative to the rotor shaft is prevented even if the pin retains the rotor shaft and the rotor with a clearance in some positions.

There exists a possibility to arrange the pin radially or axially. Basically, there exists also a possibility to arrange the pin radially inclined.

According to a further advantageous embodiment of the present invention, the pin is arranged in a groove or a bore formed in the centering journal of the rotor. The pin engages with one of its ends in the groove or the bore of the rotor and with another end in the groove or the bore of the rotor shaft.

According to a further advantageous embodiment of the present invention, the safety element is formed as a friction ring. The friction ring has, as a result of selection of an appropriate material and/or a corresponding surface coating, a higher friction coefficient in comparison with rotor and stator components, higher than the friction coefficient which is directly achieved between respective surfaces of the rotor and the rotor shaft. The friction ring is arranged between the rotor and the rotor shaft, preferably between the end surface of the rotor shaft and the surface of the centering journal of the rotor facing the end surface of the rotor shaft. This embodiment insures that the relative rotation between the rotor and the rotor shaft is prevented, without the need to structurally change the rotor or the rotor shaft.

According to a still another advantageous embodiment of the present invention, for increasing the friction coefficient, a coating layer is provided on one or both of connection or bearing surfaces of the rotor and the rotor shaft. With this embodiment, it is possible to prevent a relative rotation between the rotor and the rotor shaft, without using a friction ring.

Basically, there exists a possibility to use both the friction ring and providing a coating on one or both connection or bearing surfaces of the rotor and the rotor shaft.

A yet another advantageous embodiment of the present invention provides a projection in one of the cooperating contact surfaces of the rotor and the rotor shaft and that forms a plastic deformation in an opposite of the contact surfaces of the rotor and the rotor shaft, with the plastic deformation defining a counter-projection.

Such a projection can be formed, e.g., as a so-called punch mark. This punch mark can be formed, e.g., of a rotor material. When the rotor is pressed against the rotor shaft, upon tightening of the fastening element, e.g., a screw, the punch mark plastically deforms the adjacent surface. When the punch mark is provided in the rotor, it plastically deforms the rotor shaft. It is also possible to provide a punch mark in the rotor shaft. Then, the punch mark plastically deforms the rotor. Formation one or several punch marks is advantageous when the rotor and the rotor shaft are formed of different materials. In this case, the punch mark is formed in a material having a greater strength, i.e., a high yield stress Re. In this case, the punch mark is pressed in a softer material.

According to a still further advantageous embodiment of the invention, a radially extending projection is provided in the rotor or the rotor shaft, and a recess for formlockingly receiving the projection is provided in another of the rotor and the rotor shaft.

There is also exists, e.g., a possibility to provide a radial circular elevation having different heights on the end surface of the rotor shaft. A corresponding counter-recess is then provided on the rotor in which the elevation is received. This likewise prevents relative rotation between the rotor and the rotor shaft.

According to a further embodiment, a projection extending in the radial direction is provided in the rotor shaft or the rotor, and in another of the rotor and the rotor shaft, a recess for formlockingly receiving the projection is provided. In this embodiment, it is contemplated, e.g., to provide a projecting nose on the centering journal of the rotor and which is received in a groove in the rotor shaft. The groove defines a stop for the nose, so that the relative rotation of the rotor and the rotor shaft is prevented.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments of a rotor/rotor shaft connection, when read with reference to the accompanying drawings.

DETAILED DESCRIPTION OF THE PREFERRED EMBODIMENTS

Figure 1:
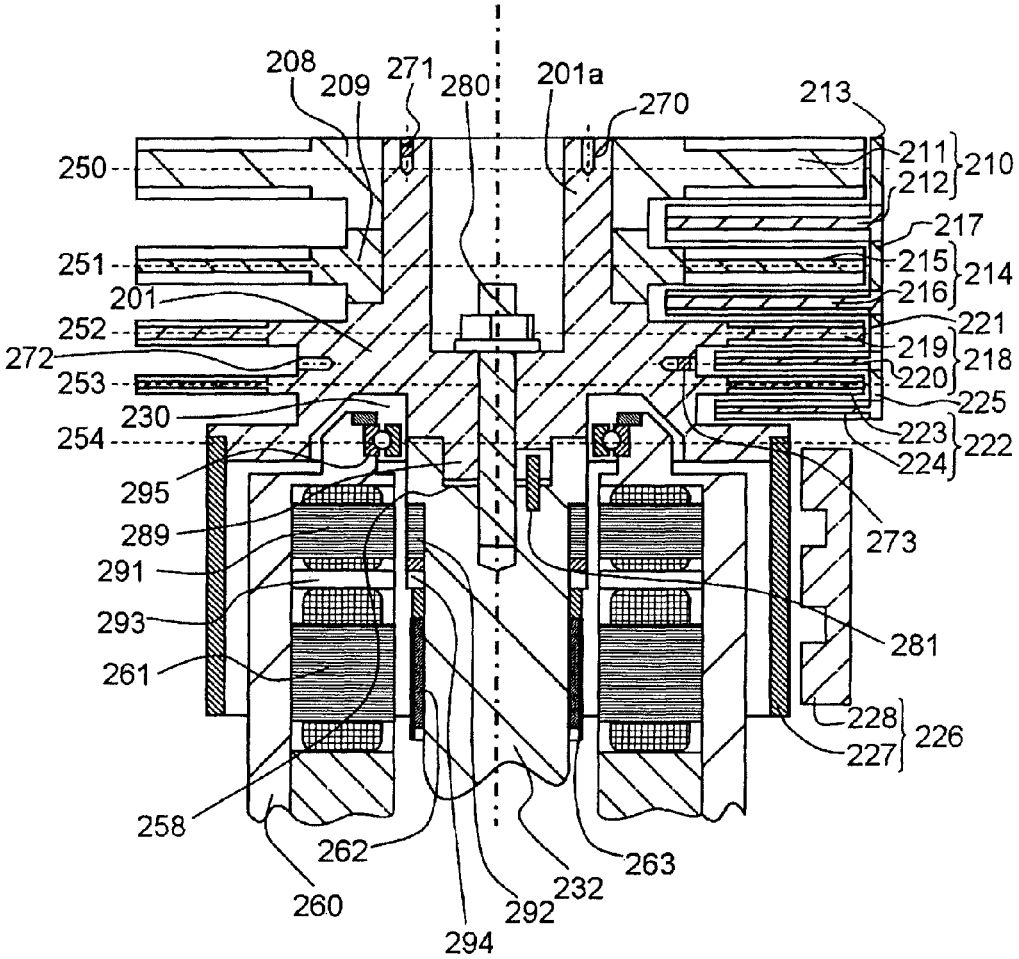
FIG. 1 a longitudinal cross-sectional view of a rotor of a turbomolecular pump and of the drive region of the turbomolecular pump according to the state of the art.

FIG. 1 shows a cross-sectional view of a turbomolecular pump according to the state of the art. In the pump, a shaft 232, which is located in the pump housing 260, is surrounded by a safety bearing 295, a radial bearing coil 291, a radial sensor 293, and a motor coil 261. The motor coil 261 cooperates with a motor magnet 262 secured on the shaft 232 with a sleeve 263, so that upon energizing the motor coil 261, the shaft 232 rotates with a greater speed. The radial sensor 292 cooperates with a shaft-side radial sensor target 294.

The turbomolecular pump stationary structure is formed of a Holweck stator 228 located adjacent to fore-vacuum and in which helix-shape channels extend that cooperate with a sleeve 227 arranged on the rotor, with the Holweck stator 228 and the sleeve 227 forming a Holweck stage 226.

Further stationary structures are formed by stator discs 212, 216, 220 and 224 which are provided with blade rings and which are axially spaced from each other by spacer rings 213, 217, 221, and 225. In the axial intermediate spaces between the stator disc 212, 216, 220 and 224, pump structures which are formed as rotor blades 211, 215, 219 and 223 extend. Stationary and rotor-side pump structures cooperate in pairs. The rotor blade 211 and the stator disc 212 form together a first pump stage 210 adjacent to the chamber and operating in high vacuum. Correspondingly, the stator disc 216 and the rotor blade 215 form the following second stage 214, the stator disc 220 and the rotor blade 219 from the third stage, and, finally, the stator disc 224 and the rotor blade 223 form the fourth stage 222 that provides for transmission of pressure to the Holweck stage 228. The blades are located in spaced from each other, planes 250, 251, 252, and 253, with the plane 254 forming the connection region of the rotor sleeve.

The rotor-side pump structures in form of rotor blades 219 and 223 are provided on the first rotor part 201 and form therewith a one-piece body. The rotor Holweck sleeve is connected with the first rotor part 201. The first rotor part 201 has a recess 230 in its center. The recess forms a hollow space extending radially and axially from the center, and receives, at least partially, the safety bearing 295.

The first rotor part 201 is connected to the end side 258 of the rotor shaft 232 by a fastening element, e.g., a screw 280. The shaft 232 has a recess in which a journal 289 of the first rotor part 201 engages. This simplifies the radial positioning. The first rotor part 201 has, in the embodiment shown in the drawing, a retaining section 201*a* that extends axially from the first rotor part 201 in the high-vacuum direction, i.e., in the direction remote from the rotor shaft 232. A retaining ring 208 is arranged on the retaining section 201*a*. The rotor blade 211 is connected with the retaining ring 208. A further retaining ring 209 and the rotor blade 215 are likewise connected with each other. The retaining rings with rotor blades are conveniently formed.

Balancing boreholes 270, in which balancing weights 271 can be inserted, are provided in the end side retaining section 201*a*. In the rotor blades 219 and 223, also balancing bores 272 can be provided in which balancing weights 273 can be arranged In order to prevent rotation of the first rotor part 201 relative to the shaft 232, a pin 281 is used as a rotation preventing or safety element and has one of its ends secured in the first rotor part 201 and the other of its ends secured in the shaft 232. Because the pin 281 is radially spaced from the centrally located screw 280, it prevents rotation of the first part 201 relative to the shaft 232.

Figure 2A:
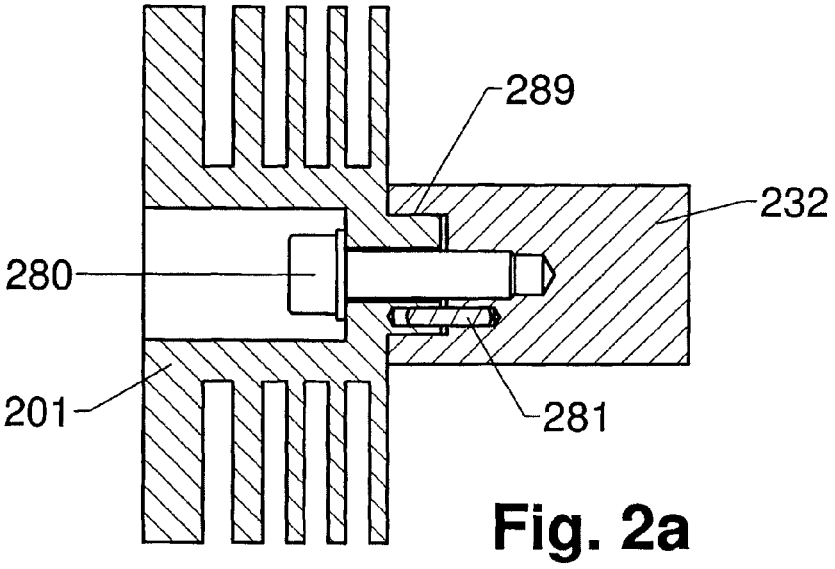
FIG. 2*a* a longitudinal cross-sectional view of a rotor/rotor shaft connection with a pin.

FIG. 2 shows the rotor shaft 232 on which the rotor part 201 is secured with the screw 280. The pin 281 prevents rotation of the rotor part 201 relative to the rotor shaft 232.

Figure 2B:
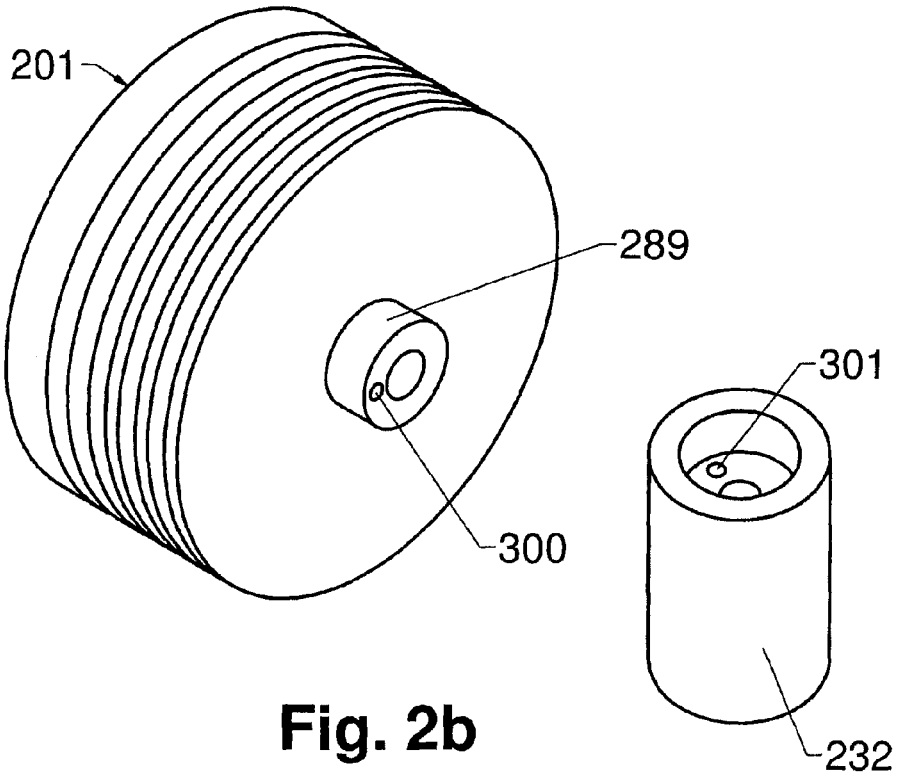
FIG. 2*b* a perspective view of the rotor and the shaft shown in FIG. 2*a* in a non-connected condition.

According to FIG. 2*b*, an axial bore 300 is formed in the central journal 289. In the shaft 232, likewise, a bore 301 is formed. The pin 281, not shown in FIG. 2*b*, engages with its opposite ends in the bores 300 and 301.

Figure 3A:
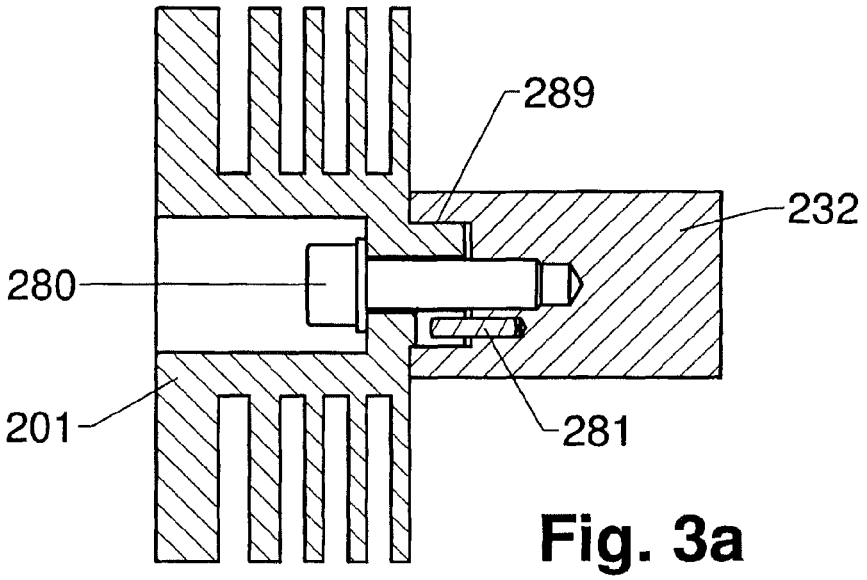
FIG. 3*a* a longitudinal cross-sectional view of a rotor/rotor shaft connection according to another embodiment of the present invention.
Figure 3B:
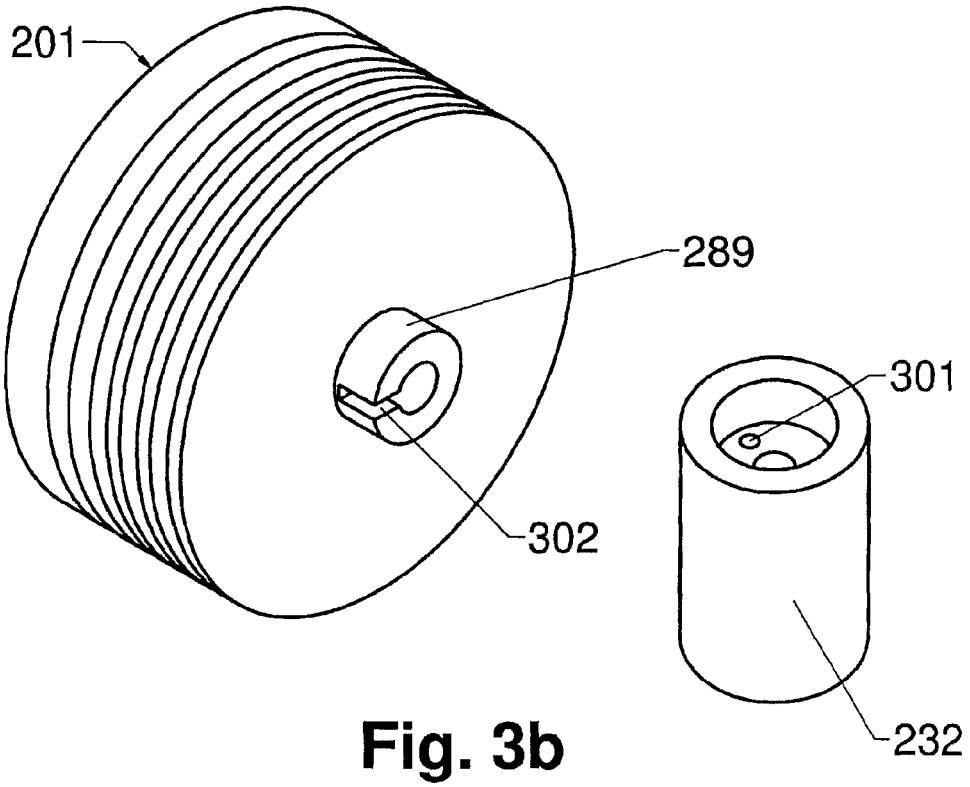
FIG. 3*b* a perspective view of the rotor and the shaft shown in FIG. 3*a* in a non-connected condition.

FIGS. 3*a* and 3*b* show the rotor shaft 232 in which again the bore 301 is formed. The centering journal 289 of the rotor part 201 has, instead of a bore, a groove 302. The pin 281 has one of its ends arranged in the bore 301 of the rotor shaft 232, and has the other of its ends arranged in the groove 302 of the centering journal 289.

The advantage of the embodiment with the groove 302 in comparison with the embodiment with a bore consists in that the groove 302 permits to build a statically determined fit system, without maintaining precise tolerances. The radial centering of the rotor part 201 and the rotor shaft 232 is effected with the centering journal 289. Two further bores with a pin, which must be aligned, would negatively influence this solution because of available tolerances and plays.

The groove 302 insures that the pin 281 alone provides for the rotatory degree of freedom, while both radial degrees of freedom, which are insured by the centering journal 289, are not influenced.

Figure 4A:
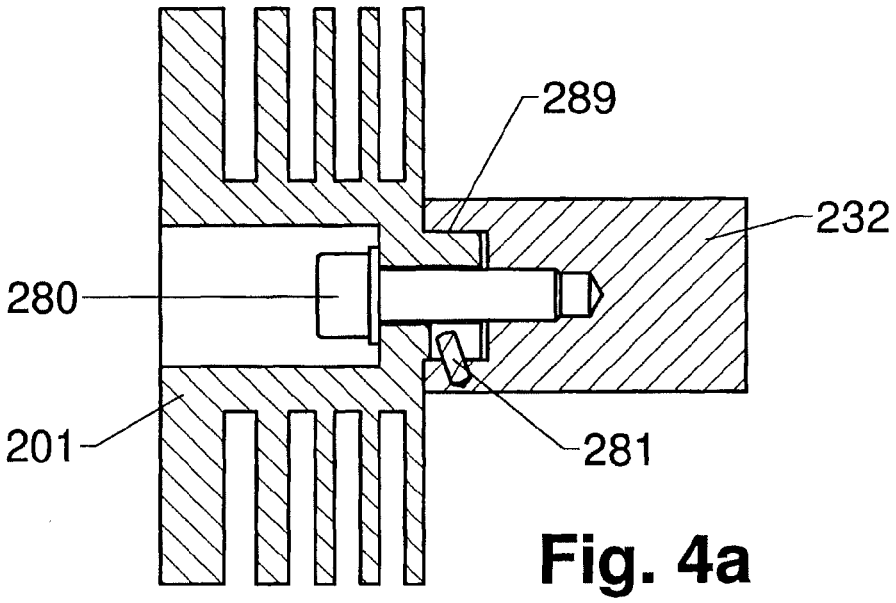
FIG. 4*a* a longitudinal cross-sectional view of a rotor/rotor shaft connection with a radially inclined pin.
Figure 4B:
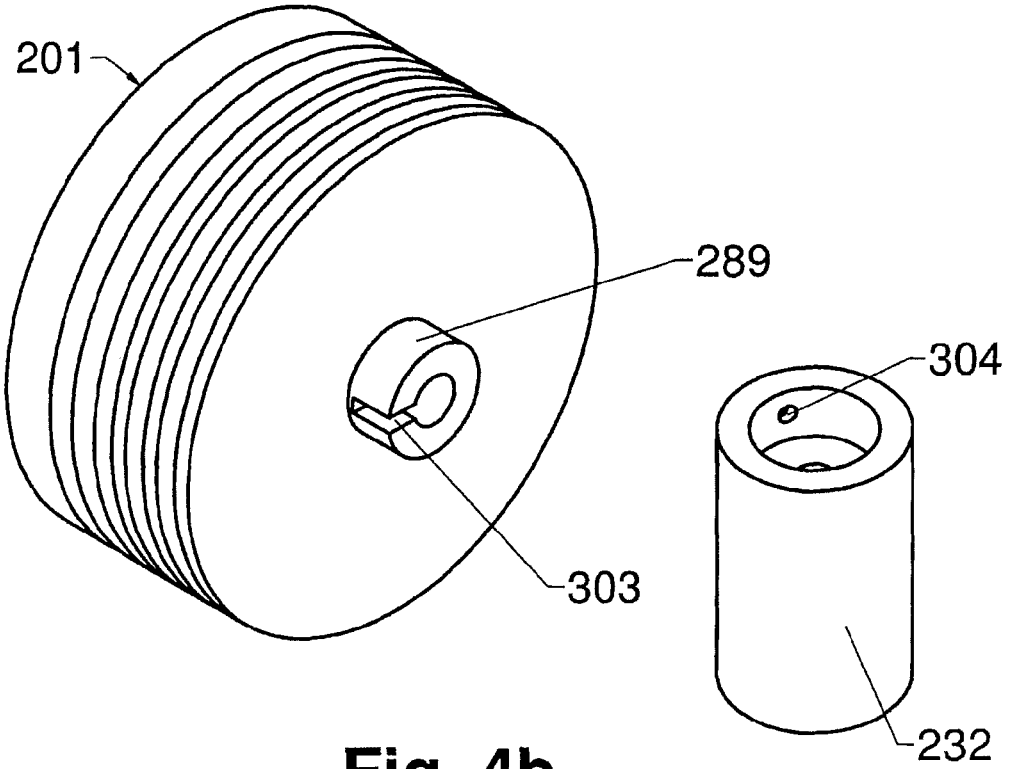
FIG. 4*b* a perspective view of the rotor and the shaft shown in FIG. 4*a* in a non-connected condition.

According to FIGS. 4*a* and 4*b*, the pin 281 is arranged in the groove 303 of the centering journal 289 of the rotor part 201 with a radial inclination and extends into a radial bore 304 of the shaft 232.

In this embodiment, the pin 281 is secured by a centrifugal force.

Figure 5A:
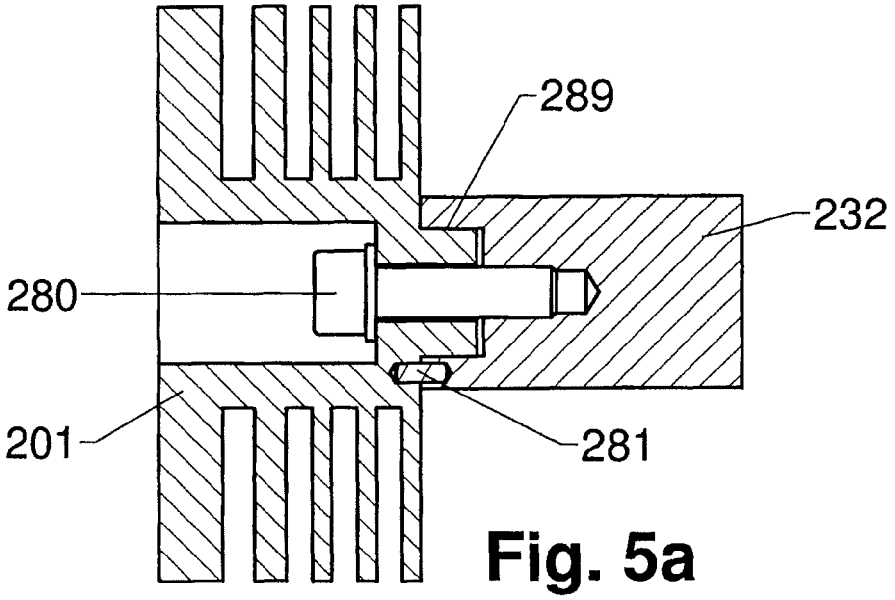
FIG. 5*a* a longitudinal cross-sectional view of a rotor/rotor shaft connection according to a further embodiment of the present invention.
Figure 5B:
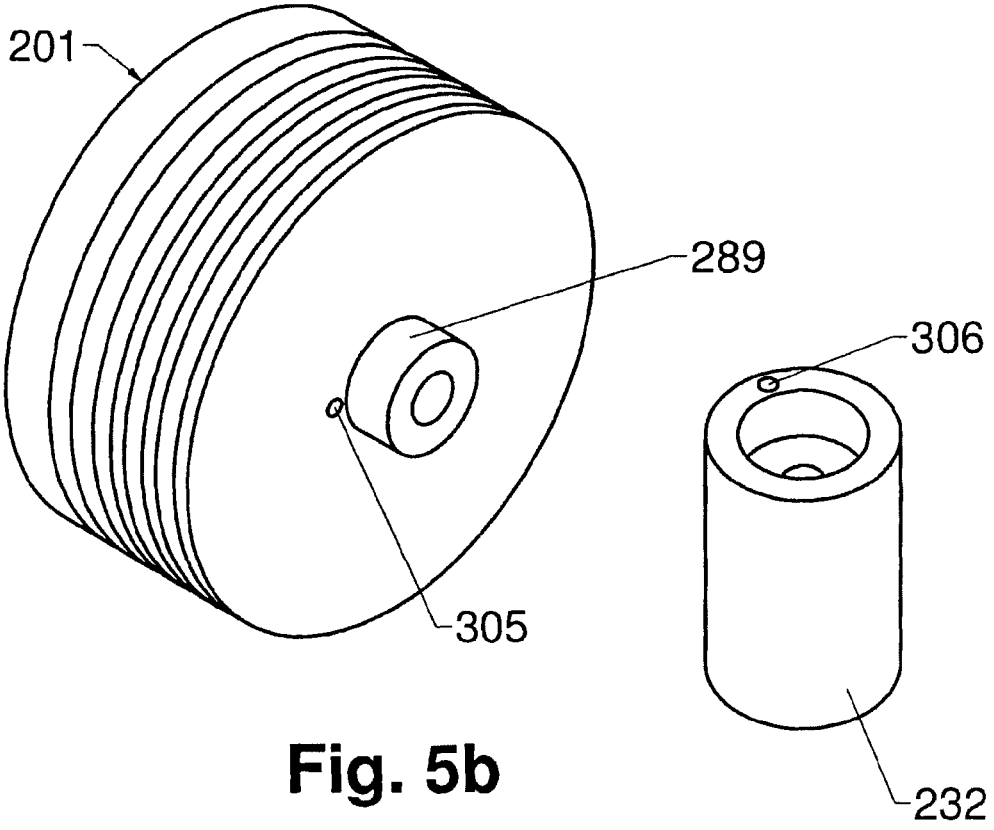
FIG. 5*b* a perspective view of the rotor and the shaft shown in FIG. 5*a* in a non-connected condition.

According to FIGS. 5*a* and 5*b*, the pin 281 is arranged in the bore 305 of the rotor part 201 so that it is radially spaced from the region of the centering journal 289. A corresponding counter-bore 306 is provided in the shaft 232. The bore 305 is provided in the rotor part 201 in contact with the bearing surface of the shaft 232.

Figure 6A:
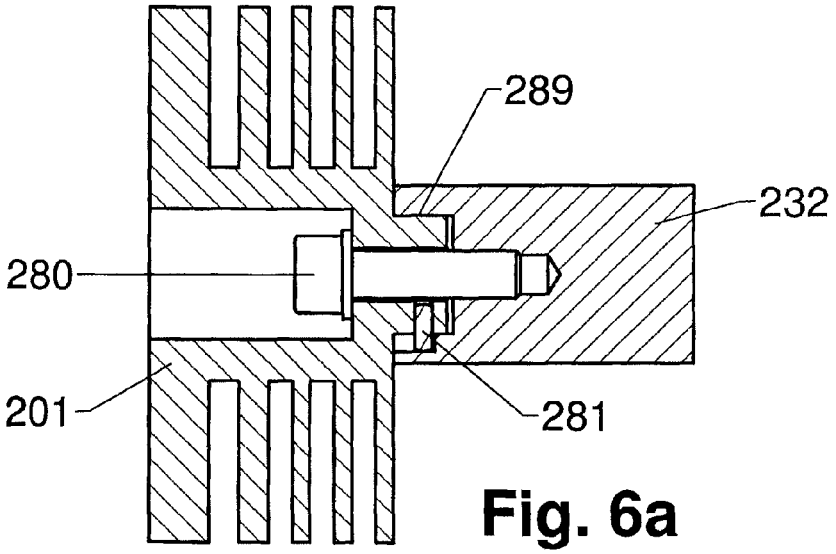
FIG. 6*a* a longitudinal cross-sectional view of a rotor/rotor shaft connection with a radial pin.
Figure 6B:
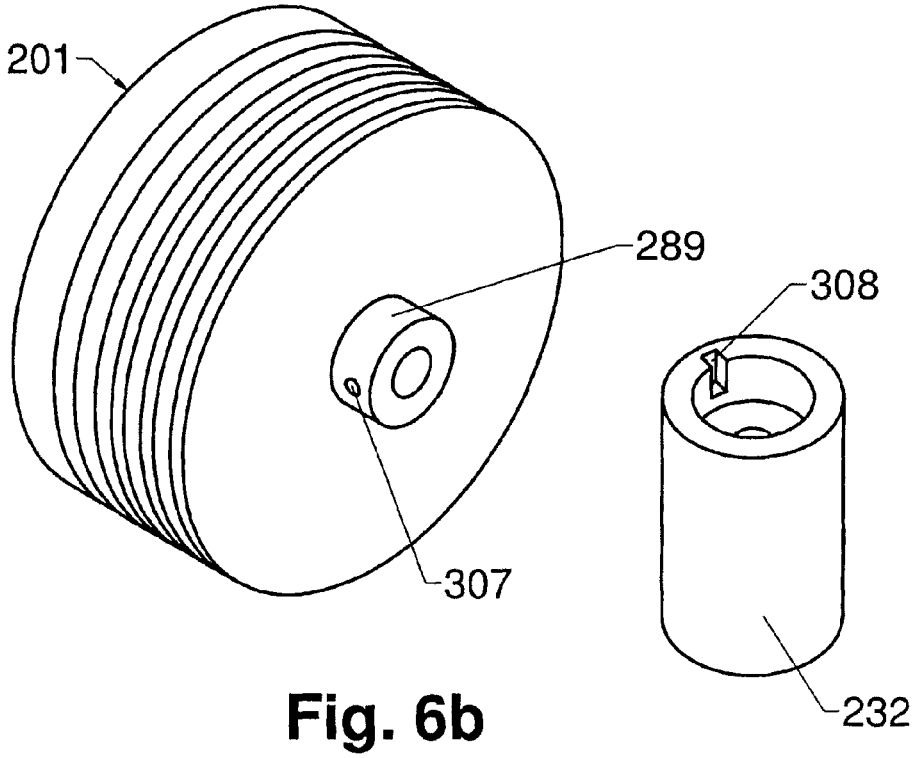
FIG. 6*b* a perspective view of the rotor and the shaft shown in FIG. 6*a* in a non-connected condition.

FIGS. 6*a* and 6*b* show a further embodiment. The pin 281 extends radially into the rotor centering journal 289, being arranged in the bore 307 of the centering journal 289. The other end of the pin 281 engages in a groove 308 in the shaft 232.

Figure 7A:
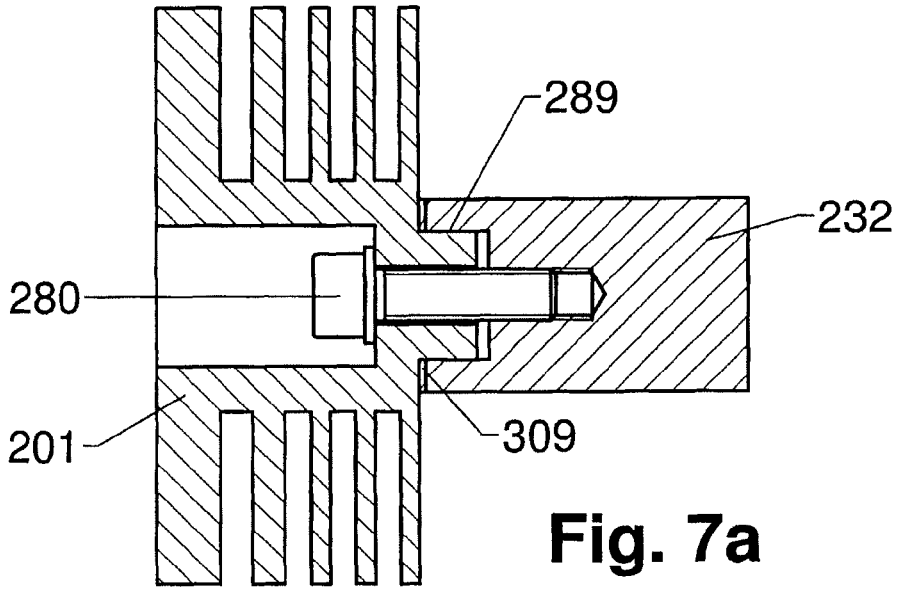
FIG. 7*a* a longitudinal cross-sectional view of a rotor/rotor shaft connection with a friction ring.
Figure 7B:
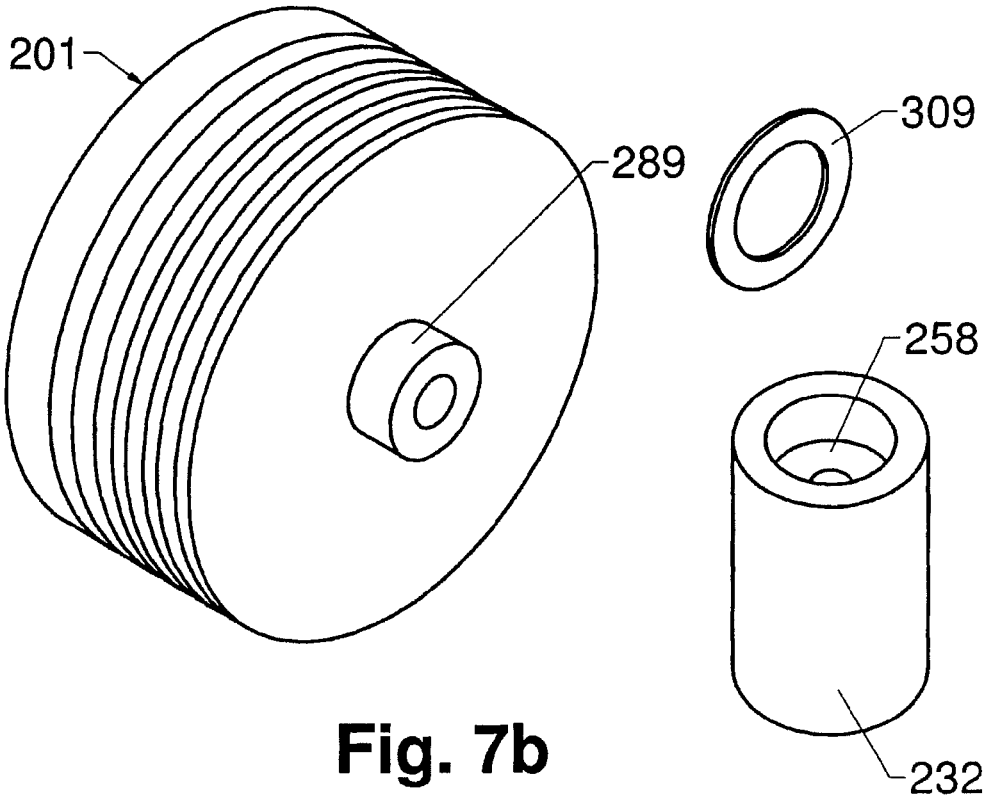
FIG. 7*b* a perspective view of the rotor and the shaft shown in FIG. 7*a* in a non-connected condition.

Another embodiment is shown in FIGS. 7*a* and 7*b*. In this embodiment, a friction ring 309 is provided between the centering journal 289 and the end side 258 of the shaft 232. The screw 280 presses the rotor part 201 to the shaft 232. The friction ring 309 prevents rotation of the rotor part 201 relative to the shaft 232.

Figure 8A:
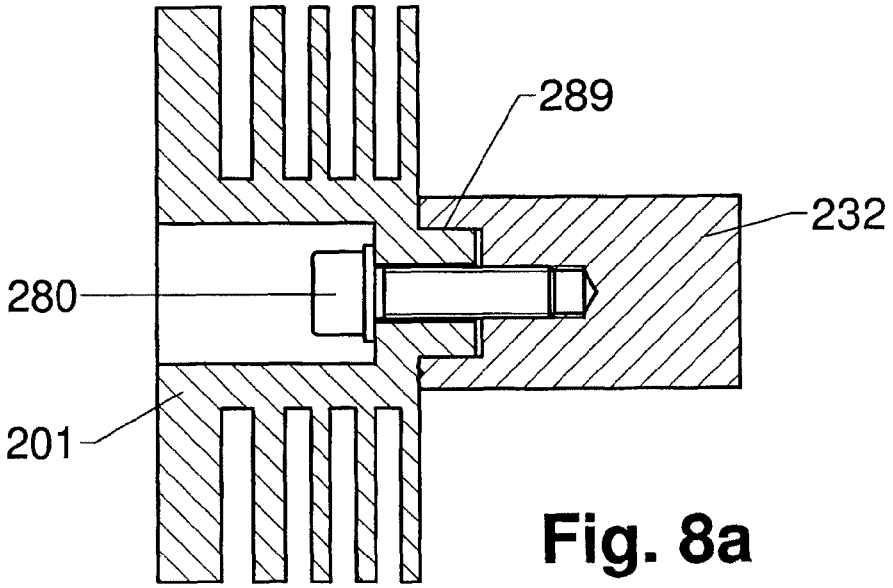
FIG. 8*a* a longitudinal cross-sectional view of a rotor/rotor shaft connection with a punch mark.
Figure 8B:
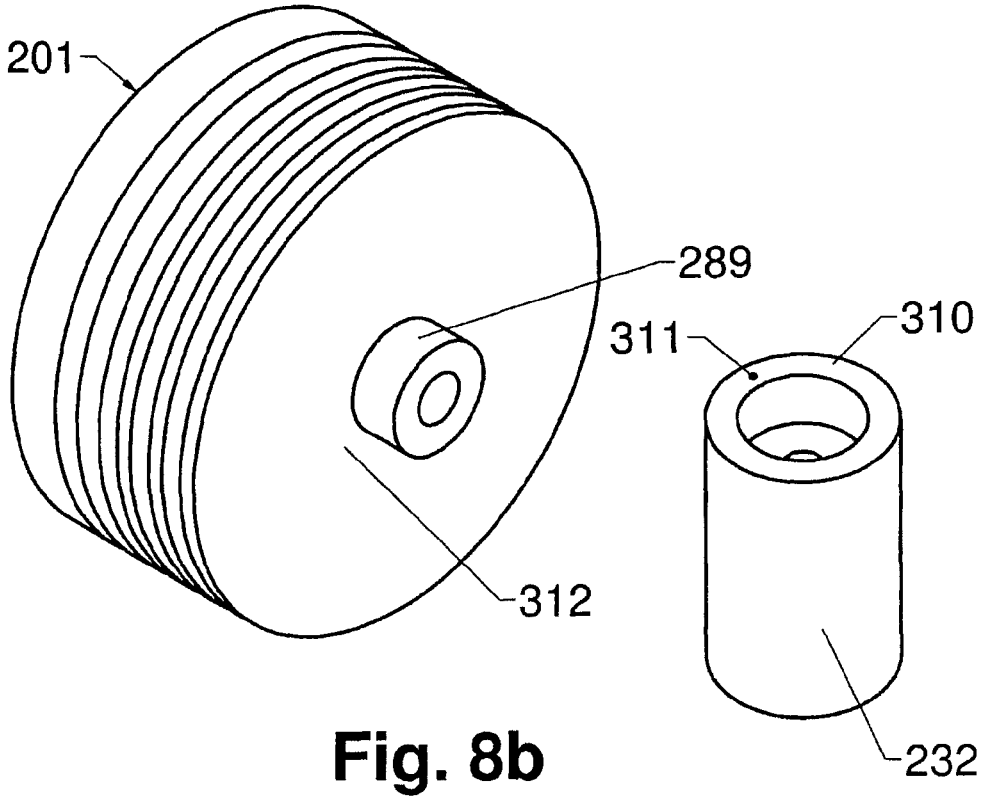
FIG. 8*b* a perspective view of the rotor and the shaft shown in FIG. 8*a* in a non-connected condition.

According to the embodiment shown in FIGS. 8*a* and 8*b*, a punch mark 311 is provided on the contact surface 310 of the shaft 232. The punch mark lies on the contact surface 312 of the rotor part 201. The shaft 232 is formed of a stronger material than the rotor part 201. When the rotor part 201 is connected with the shaft 232 by the screw 280, the punch mark 311 plastically deforms the contact surface 312 of the rotor part 201. The interlocking of the punch mark 311 with the deformed contact surface provides a form-locking connection that prevents the rotation of the rotor part 201 relative to the shaft 232. It is possible to provide several punch marks.

Figure 9A:
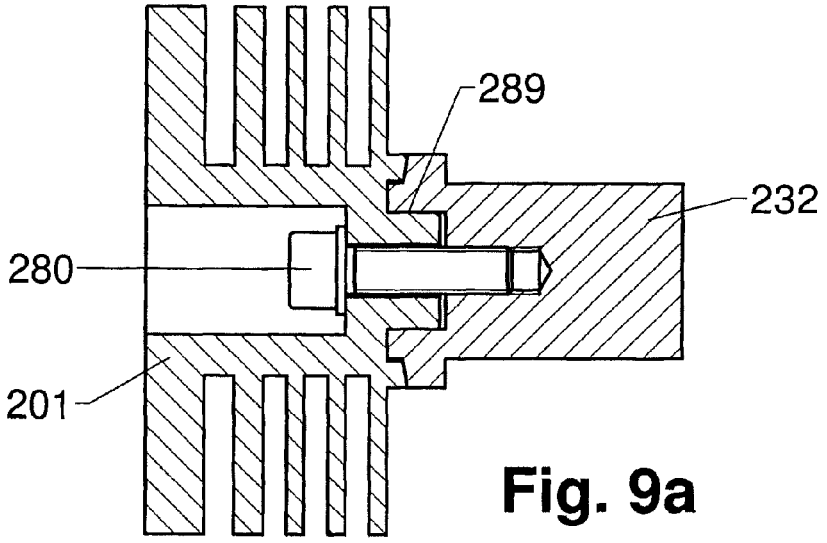
FIG. 9*a* a longitudinal cross-sectional view of a rotor/rotor shaft connection with an axial geometrical safety element.
Figure 9B:
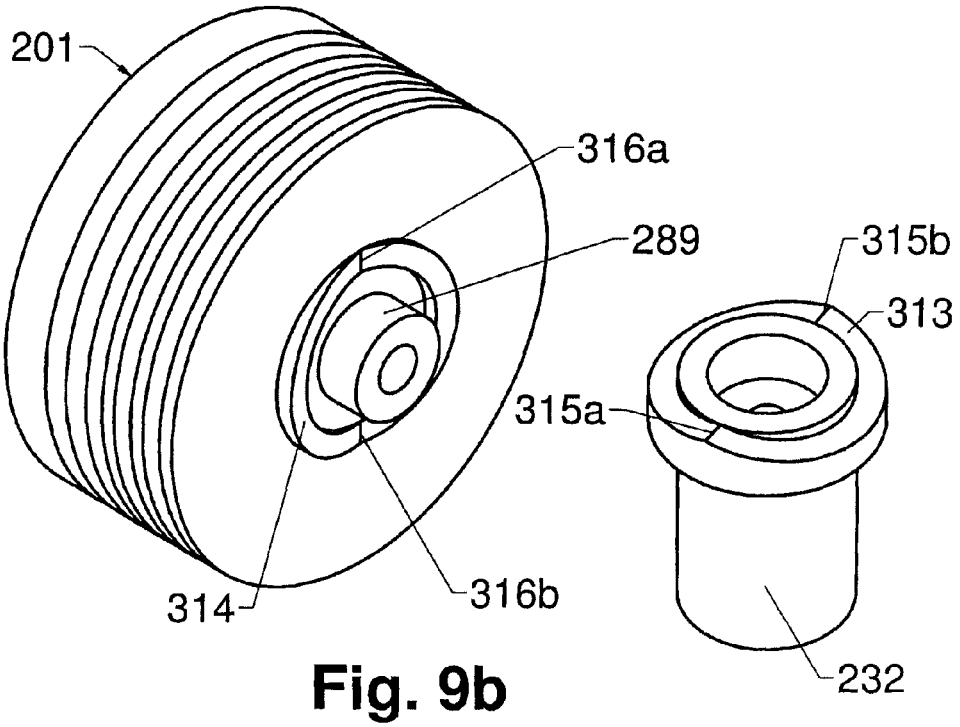
FIG. 9*b* a perspective view of the rotor and the shaft shown in FIG. 9*a* in a non-connected condition.

According to FIGS. 9*a* and 9*b*, the shaft 232, has, as its end, a deformed geometrical safety element 313 projecting in the axial direction, with its counter-part 314 being provided in the rotor part 201. The projecting in the axial direction, deformed geometrical safety element 313 has two elevations 315*a*, 316*b* engaging in corresponding indentations 316*a*, 316*b*. The formlocking connection of elements 313 and 314 prevents relative rotation between the rotor part 201 and the rotor shaft 232.

Figure 10A:
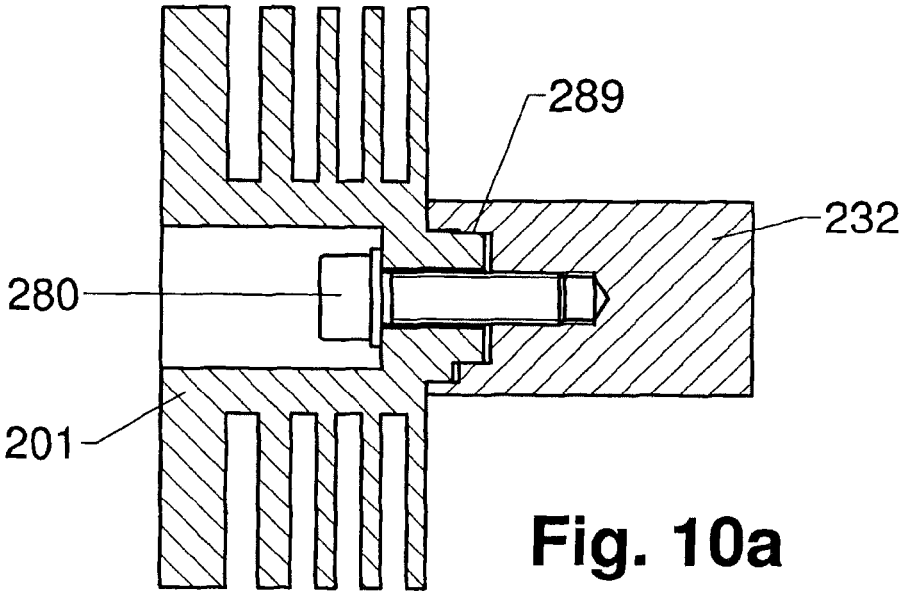
FIG. 10*a* a longitudinal cross-sectional view of a rotor/rotor shaft connection with a radial geometrical safety element.
Figure 10B:
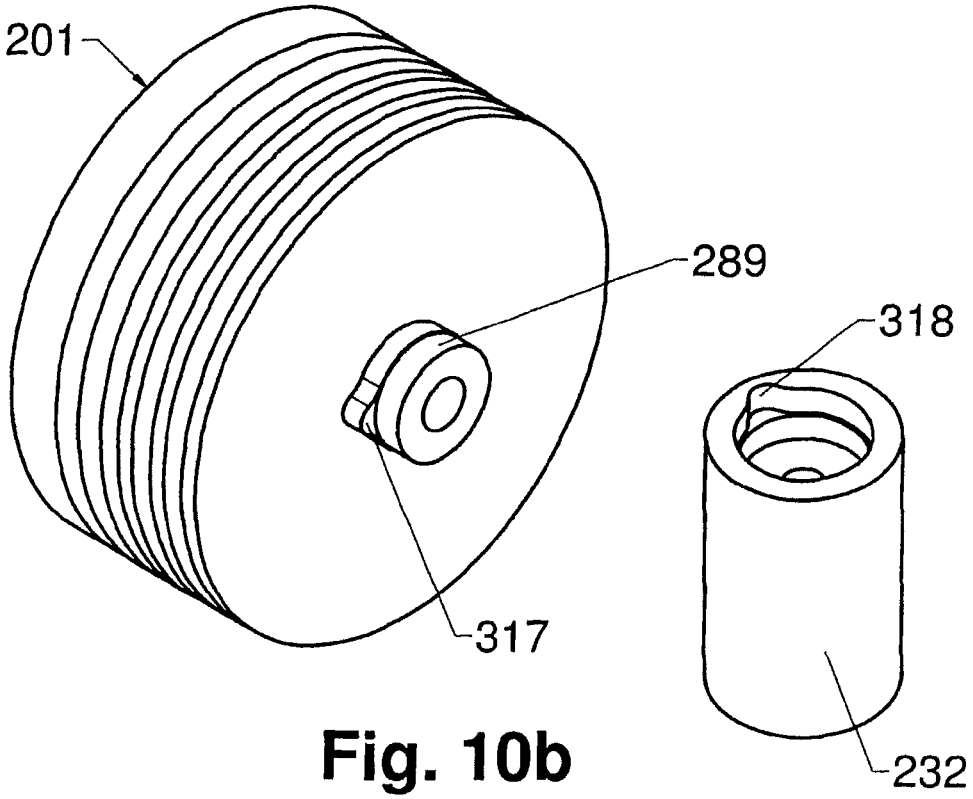
FIG. 10*b* a perspective view of the rotor and the shaft shown in FIG. 10*a* in a non-connected condition.

A still further embodiment of the present invention is shown in FIGS. 10*a* and 10*b*. In this embodiment, the centering journal 289 has an extending in the radial direction, deformed projection 317 arranged in a groove 318 of the rotor shaft 232.

In the groove 318 of the rotor shaft 232, there is provided a stop (not shown), whereby rotation of the rotor part 201 relative to the shaft 232 is prevented.

It is possible to combine the embodiments shown in FIGS. 1 through 10 with each other.

Though the present invention was shown and described with references to the preferred embodiments, such are merely illustrative of the present invention and is not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A vacuum pump, comprising at least one gas inlet opening; at least one gas outlet opening; at least one rotor shaft; a rotor mounted on the at least one rotor shaft and having rotatable therewith pump active components arranged opposite stationary pump active components; at least one fastening element extending in an axial direction and provided in or on the rotor shaft for securing the rotor on the rotor shaft; and at least one safety element provided in addition to the at least one fastening element for preventing rotation of the at least one rotor and the at least one rotor shaft relative to each other, wherein the rotor and the rotor shaft have cooperating contact surfaces, wherein the safety element comprises at least one projection provided in one of the cooperating surfaces of the rotor and the rotor shaft for forming a plastic deformation in an opposite of the contact surfaces of the rotor and the rotor shaft, the plastic deformation defining a counter-projection.

2. A vacuum pump according to claim 1, wherein the safety element is provided on one of centering journal of the at least one rotor and the rotor shaft.

3. A vacuum pump according to claim 1, wherein the safety element is formed as at least one pin engaging through or in the rotor shaft and or in the rotor.

4. A vacuum pump according to claim 3, wherein the at least one pin is arranged axially or radially.

5. A vacuum pump according to claim 3, wherein the at least one rotor has a centering journal, wherein one of the rotor and the centering journal has one of bore and groove, and wherein the pin is arranged in the one of bore and groove in one of the rotor and the rotor journal.

6. A vacuum pump according to claim 1, wherein the safety element is formed as a friction ring located between the rotor and the rotor shaft.

7. A vacuum pump according to claim 1, wherein the safety element is formed as one of one-sided and two-sided coating layer provided respectively on one or both connection or bearing surfaces of the rotor and the rotor shaft.

8. A vacuum pump according to claim 1, wherein the at least one projection is formed as a punch mark, and the counter-projection is defined by an indentation formed as a result of the plastic deformation of the opposite of the contact surfaces.

9. A vacuum pump according to claim 1, wherein the at least one projection is formed as an elevation, and the counter-projection is defined by an indentation formed as a result of the plastic deformation of the opposite of the contact surfaces.

* * * * *